US008813654B2

(12) United States Patent
Müller et al.

(10) Patent No.: US 8,813,654 B2
(45) Date of Patent: Aug. 26, 2014

(54) RUNNING GEAR FRAME FOR A RUNNING GEAR OF A RAIL VEHICLE

(75) Inventors: Detlef Müller, Seigen (DE); Matthias Kwitniewski, Aachen (DE); Igor Geiger, Krueztal (DE); Paul Gier, Aachen (DE); Heiko Mannsbarth, Wiesbaden (DE)

(73) Assignee: Bombardier Transportation GmbH, Berlin (DE)

( * ) Notice: Subject to any disclaimer, the term of this patent is extended or adjusted under 35 U.S.C. 154(b) by 68 days.

(21) Appl. No.: 13/220,875

(22) Filed: Aug. 30, 2011

(65) Prior Publication Data

US 2012/0234201 A1 Sep. 20, 2012

(30) Foreign Application Priority Data

Mar. 16, 2011 (DE) ..... 20 2011 004 025 U

(51) Int. Cl.
*B61F 5/52* (2006.01)

(52) U.S. Cl.
USPC ..... 105/172; 105/226; 105/230

(58) Field of Classification Search
USPC ..... 105/206.1, 206.2, 226, 227, 228, 229, 105/230, 172, 182.1, 157.1
See application file for complete search history.

(56) References Cited

U.S. PATENT DOCUMENTS

| | | | | | |
|---|---|---|---|---|---|
| 578,627 | A | * | 3/1897 | Cloud | 105/206.1 |
| 816,010 | A | * | 3/1906 | Goodwin | 105/226 |
| 1,038,481 | A | * | 9/1912 | Blake | 105/198 |
| 1,869,110 | A | * | 7/1932 | McCool | 105/226 |
| 2,552,019 | A | * | 5/1951 | Stertzbach | 105/230 |
| 6,089,166 | A | * | 7/2000 | Callahan et al. | 105/226 |

* cited by examiner

*Primary Examiner* — Mark Le
(74) *Attorney, Agent, or Firm* — The Webb Law Firm

(57) ABSTRACT

A running gear frame for a rail vehicle includes a central transverse beam, and two longitudinal beams connected together in a frame transverse direction via the transverse beam, wherein the transverse beam has at least a front web element, a rear web element and a transverse beam lower chord. The web elements run between the longitudinal beams in the frame transverse direction and in a frame height direction and are connected therewith and are arranged spaced apart in a frame longitudinal direction. The transverse beam lower chord extends on an underside of the transverse beam between the longitudinal beams and is connected with the web elements. Furthermore, the transverse beam lower chord extends beyond the front web element and/or the rear web element by at least 10% of the web element distance.

21 Claims, 2 Drawing Sheets

RUNNING GEAR FRAME FOR A RUNNING GEAR OF A RAIL VEHICLE

BACKGROUND OF THE INVENTION

The present invention relates to a running gear frame for a rail vehicle with a central transverse beam and two longitudinal beams connected together in a frame transverse direction via the transverse beam, wherein the transverse beam has at least a front web element, a rear web element and a transverse beam lower chord. The web elements run between the longitudinal beams in the frame transverse direction and a frame height direction and are connected therewith and are arranged spaced apart in a frame longitudinal direction at least by a web element distance. The transverse beam lower chord extends on an underside of the transverse beam between the longitudinal beams and is connected with the web elements. The invention furthermore concerns a running gear with a running gear frame according to the invention and a rail vehicle with a running gear according to the invention.

In modern rail vehicles which are operated at comparatively high nominal speeds, usually the problem occurs that at particular points in the vicinity of the running gear at which the air flow detaches from the vehicle components arranged there, flow conditions occur which at high speeds lead to a substantial increase in drag and considerable sound emissions. This is partly because downstream of the detachment point, a continuously widening shear layer is formed. The wider this shear layer expands, the greater the associated drag. Furthermore in this shear layer usually periodic pronounced vortices are formed (so-called Kelvin-Helmholtz instability) with associated sound emission.

If this shear layer hits running gear components such as for example the underside of a drive motor or a transverse beam of a running gear frame, further turbulence is induced which leads to an increase in drag and sound emissions.

SUMMARY OF THE INVENTION

The present invention is therefore based on the object of providing a running gear frame, a running gear and a rail vehicle of the type cited initially which does not entail or only entails to a lesser extent the above disadvantages and, in particular, in a simple manner allows a reduction in drag and sound emissions.

The present invention is based on the technical teaching that in a simple manner a reduction in sound emission in the area of the running gear and a reduction in drag of the vehicle are achieved if the transverse beam lower chord, at least over a certain region extending in the frame transverse direction, protrudes pronouncedly forward and/or rearward in the frame longitudinal direction beyond the web elements. The protrusion of transverse beam lower chord formed in this manner has the advantage over conventional designs, in which the transverse beam lower chord at best protrudes only slightly beyond the web elements, that the incident air flow starting from a leading running gear component (for example a drive motor, gearbox, wheelset or similar) can re-attach earlier at the transverse beam lower chord by forming a further boundary layer, while in the region of the trailing protrusion a later detachment of the low drag air flow is achieved.

As a result of the earlier re-attachment and later detachment of the air flow, in the area of the transverse beam, a shear layer forms only behind the transverse beam (in the direction of travel) and cannot expand again until there, so that, over the running gear region as a whole, a reduction in expansion of the shear layer is achieved. This leads to reduced sound emission and reduced drag.

It is evident that running gear components trailing in the air flow in the area of their underside can also be formed such that the flow re-attaches there, so that, overall, a clear reduction in sound emission and drag is achieved.

According to one aspect the invention therefore relates to a running gear frame for a rail vehicle with a central transverse beam and two longitudinal beams which are connected together in a frame transverse direction via the transverse beam, the transverse beam having at least a front web element, a rear web element and a transverse beam lower chord. The web elements run between the longitudinal beams in the frame transverse direction and a frame height direction and are connected therewith and are arranged spaced apart in a frame longitudinal direction at least by a web element distance. The transverse beam lower chord extends on the underside of the transverse beam between the longitudinal beams and is connected with the web elements. The transverse beam lower chord, in at least one longitudinal protrusion extending in the frame transverse direction over a longitudinal protrusion region of the transverse beam, extends beyond the front web element and/or the rear web element in the frame longitudinal direction by at least 10% of the web element distance, preferably by at least 15% of the web element distance, further preferably by 20% to 40% of the web element distance.

It is to be noted here that the positional indications "front" and "rear" in the sense of the present invention relate to a specific direction of travel of the running gear. It is evident that the majority of the running gears according to the invention can be operated in both directions of travel so that these indications relate only to one of the two possible directions of travel. Therefore, typically, a design substantially symmetrical to the central height axis of the running gear frame is selected so that even on a reversal of direction of travel, substantially the same flow cross section results.

The size of the longitudinal protrusion in the frame longitudinal direction, in particular, depends on the dimensions of the transverse beam in the frame longitudinal direction. If the transverse beam is relatively narrow (i.e. it has a comparatively low first dimension between the web elements), the longitudinal protrusion should be dimensioned greater to achieve as early as possible a re-attachment of the flow to the transverse beam lower chord (and hence running gear) and as late as possible a detachment of the low-drag boundary layer flow or a late reformation of a shear layer.

Embodiments that are particularly favorable, not least because they are simple to achieve, are provided in transverse beams which are comparatively broad in relation to the overall length of the running gear frame. Preferably therefore the web element distance amounts to at least 10%, preferably at least 15%, further preferably 15% to 25% of a total length of the longitudinal beams in the frame longitudinal direction.

The front and rear web elements, in the sense of the present invention, are elements lying furthest out (i.e. furthest forward or rearward) in the frame longitudinal direction which directly connect the two longitudinal beams and constitute an essential component of the structural connection between the two longitudinal beams. In particular, they are essentially co-responsible for the bending stiffness of the running gear frame about its longitudinal axis and the torsional rigidity of the running gear frame about its transverse axis.

It is evident that, in certain variants of the invention, where applicable it can also be provided that separate panelling elements or similar, which make no substantial contribution to the structural rigidity of the running gear frame, form a front or rear outer limit of the transverse beam. Preferably, however, it is provided that the front web element, at least in sections in the frame longitudinal direction, forms a front outer limit of the transverse beam. Additionally or alternatively the rear web element, at least in sections in the frame longitudinal direction, can also form a rear outer limit of the transverse beam.

In the frame transverse direction, the longitudinal protrusion region can in principle extend over any suitable width. This can depend in particular on adjacent running gear components. For example if such components reach close to the transverse beam, in particular one of the two web elements, the longitudinal protrusion can be omitted in this area.

It should be noted that the longitudinal protrusion need not necessarily be formed continuous in the frame transverse direction. Rather this can also be divided into a plurality of projecting protrusion sections spaced apart in the frame transverse direction.

In preferred variants of the invention the central longitudinal axes of the longitudinal beams are spaced apart, in the frame transverse direction, by a longitudinal beam distance and the longitudinal protrusion region extends over at least 30% of the longitudinal beam distance, preferably at least 40% of the longitudinal beam distance, further preferably 50% to 70% of the longitudinal beam distance.

The position of the longitudinal protrusion regions in the frame transverse direction can again be selected in any suitable manner. In particular, again, this can be done as a function of the arrangement of adjacent running gear components. Preferably, the longitudinal protrusion region is arranged substantially centrally in the frame transverse direction. This, in particular, accounts for the fact that, typically, the wheel discs of the wheel units (e.g. the wheel sets or wheel pairs) are arranged directly on the inside next to the longitudinal beams and, firstly, reach comparatively close to the web elements of the transverse beam and, secondly, generate a correspondingly different flow picture.

To achieve the re-attachment of the air flow and a boundary layer flow with as little interference and hence drag as possible, the transverse beam lower chord has a substantially closed surface, preferably at least in the area of the longitudinal protrusion.

Particularly favorable flow conditions result when the transverse beam lower chord, at least in the area of the longitudinal protrusion, preferably at least in the longitudinal protrusion region, has a substantially flat underside. Undesirable interference with the attaching flow can thus be avoided.

It has proved particularly favorable or essential for the achievable reduction in drag and sound emission if, in particular, the sections of the transverse beam lower chord which are leading and/or trailing in the frame longitudinal direction have a substantially closed surface over their entire width. Whereas, naturally, a substantially closed surface in the centre area of the transverse beam lower chord (in relation to the frame longitudinal direction) is also beneficial, openings in this central area have a less critical effect on the achieved reduction in drag and sound emission. This is because the closed leading and trailing sections described cause a re-attachment of the flow before and after such an opening so that a brief detachment in the area of such an opening is less important.

It is therefore preferably provided that the transverse beam lower chord at least in the area of the front web element has a substantially closed surface over its entire extent in the frame transverse direction. Additionally or alternatively the transverse beam lower chord at least in the area of the rear web element has a substantially closed surface over its entire extent in the frame transverse direction.

It is evident that, in certain variants of the invention, it can be provided that the entire transverse beam lower chord has a substantially closed surface. In particular, openings can be closed by corresponding covers or similar. To guarantee easy access to certain running gear components (for maintenance purposes for example), such openings are preferably provided in the central area which is less critical in regard to air flow. Preferably, the transverse beam lower chord therefore has a passage opening in a longitudinal central region lying in the frame longitudinal direction between the web elements. Preferably, the dimension of the passage opening in the frame longitudinal direction amounts to less than 90% of the web element distance, preferably less than 80% of the web element distance, further preferably 60% to 80% of the web element distance, in order to achieve minimum resulting interference with the air flow and to guarantee a sufficient length for re-attachment of the flow in front of and behind the opening.

Preferably, the transverse dimension of the opening is selected as small as possible to limit the interference to a narrow area. Hence, in particular variants of the invention in which the central longitudinal axes of the longitudinal beams in the frame transverse direction are spaced by a longitudinal beam distance, the dimension of the passage opening in the transverse frame direction amounts to less than 30% of the longitudinal beam distance, preferably less than 20% of the longitudinal beam distance, further preferably 15% to 20% of the longitudinal beam distance.

In preferred variants of the running gear frame according to the invention, the transverse beam lower chord merges, in particular substantially steplessly, with a longitudinal beam lower chord of at least one of the longitudinal beams in order to achieve, at this point, a particularly favorable low drag air flow.

The transverse beam lower chord can, in principle, consist of any number of different components or sections. Preferably, the transverse beam lower chord, however, is formed of one piece at least over the longitudinal protrusion region.

It has proved particularly favorable if the transverse beam lower chord, in the longitudinal protrusion region, forms a lower paneling of at least one console protruding in the frame longitudinal direction from one of the web elements, in particular a console for attachment of a motor device and/or a gearbox device and/or a brake device. Thus, an unfavorable influence on the air flow by such consoles an be reduced or, where applicable, even avoided.

The running gear frame can in principle be produced in any suitable manner. For variants that are particularly simple to produce, at least one transverse beam is formed as a welded configuration.

The present invention furthermore concerns a running gear with a running gear frame according to the invention and a rail vehicle with such a running gear frame according to the invention. In principle it can be used for vehicles with any nominal operating speed. Its advantages are particularly pronounced in rail vehicles which are designed for high speed traffic with a nominal operating speed above 250 km/h, in particular above 300 km/h.

Further preferred embodiments of the invention become apparent from the dependent claims and the description of preferred exemplary embodiments given below, which refers to the enclosed drawings.

DETAILED DESCRIPTION OF THE INVENTION

Figure 1:
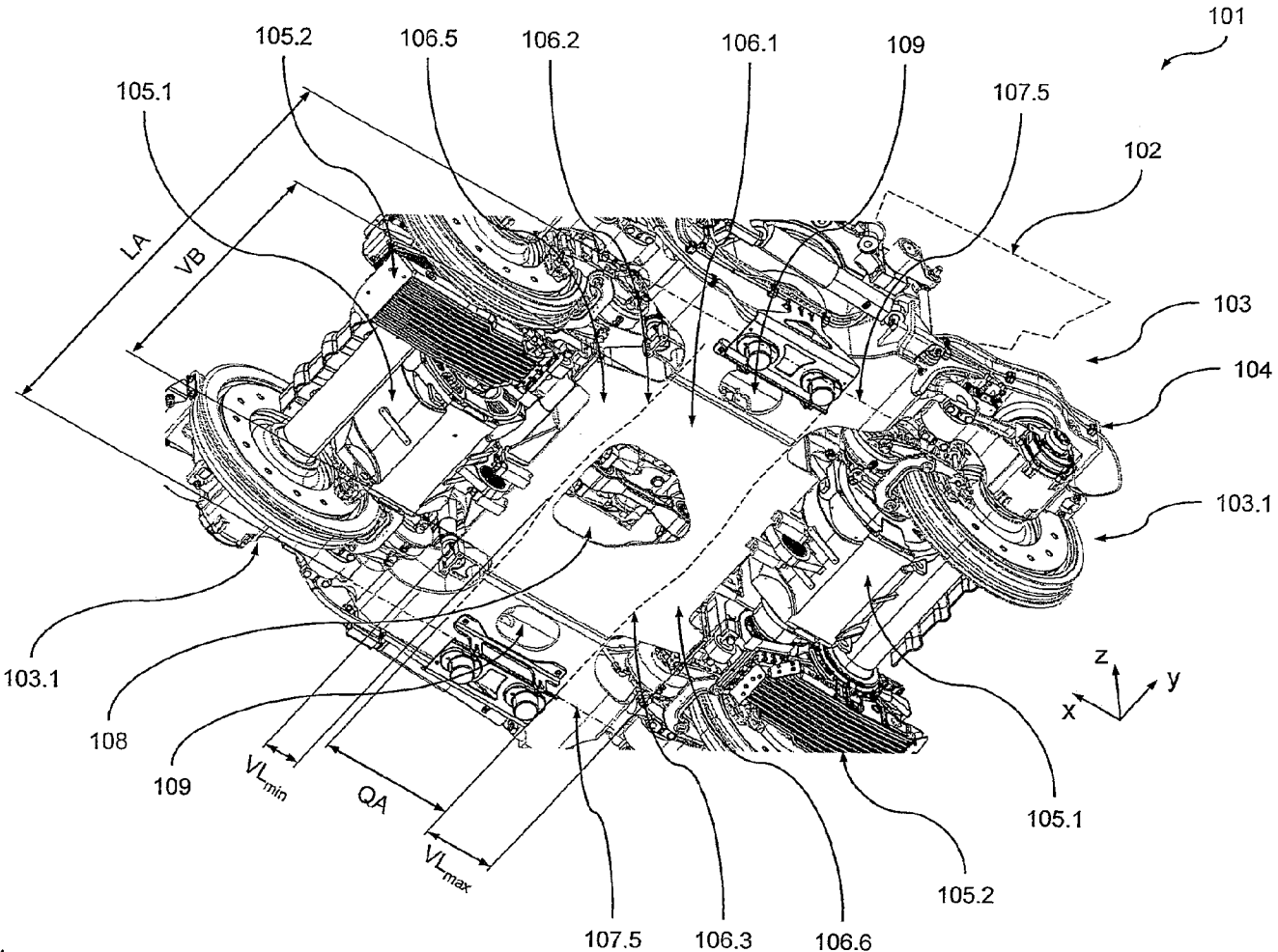
FIG. 1 is a schematic perspective bottom view of part of a preferred embodiment of the rail vehicle according to the invention, with a preferred embodiment of the running gear according to the invention, with a preferred embodiment of the running gear frame according to the invention.

With reference to FIG. 1, a preferred embodiment of the rail vehicle 101 according to the invention is described below. The rail vehicle 101 is the end wagon of a multiple unit vehicle for high speed traffic with nominal operating speeds above 250 km/h, namely $v_n$=300 km/h to 380 km/h.

The vehicle 101 comprises a wagon body (indicated by contour 102) which, in the vicinity of its two ends, is conventionally supported on a running gear in the form of a bogie 103 which comprises a bogie frame 104. It is evident, however, that the present invention can also be used in connection with other configurations in which the wagon body is supported only one a running gear.

For easier understanding of the explanations given below, a vehicle coordinate system x, y, z (specified by the wheel support plane of the bogie 103) is given in FIGS. 1 and 2 in which the x coordinate designates the longitudinal direction, the y coordinate the transverse direction and the z coordinate the height direction of the rail vehicle 101, bogie 103 or running gear frame 104, respectively.

The bogie 103 is arranged in a running gear cut-out of the wagon body 102 which at its leading end is limited by a leading wall. On both running gear sides, the running gear cut-out is confined by skirts.

The bogie 103, in a conventional manner, has two wheel units in the form of wheelsets 103.1 on which the bogie frame 104 is supported. Each wheelset 103.1 is driven via a gearbox 105.2 by a drive motor 105.1 which is mounted to the bogie frame 104 in a transversely arranged manner.

The bogie frame 104 is substantially H-shaped with a central transverse beam 106 via which its two longitudinal beams 107 are rigidly connected to each other in the frame transverse direction (y direction).

The transverse beam is a substantially box-like component which has a transverse beam lower chord 106.1 (arranged on the underside facing the track bed), a front web element in the form of a transverse web 106.2, a rear web element in the form of a transverse web 106.3 and a transverse beam upper chord 106.4, which, in the present example, are all welded together. The longitudinal beams 107 also have a fundamentally box-shaped design which essentially comprises a longitudinal beam lower chord 107.1, and inner longitudinal web 107.2, an outer longitudinal web 107.3 and a longitudinal beam upper chord 107.4.

The transverse webs 106.2 and 106.3 extending in the frame height direction (z direction) between the transverse beam lower chord 106.2 and the transverse beam upper chord run between the longitudinal beams 107 in the transverse frame direction and are rigidly connected with the inner longitudinal webs 107.2, wherein, in the connecting zone to the longitudinal beams 107, they form the front and rear outer limits of the transverse beam 106.

Figure 2:
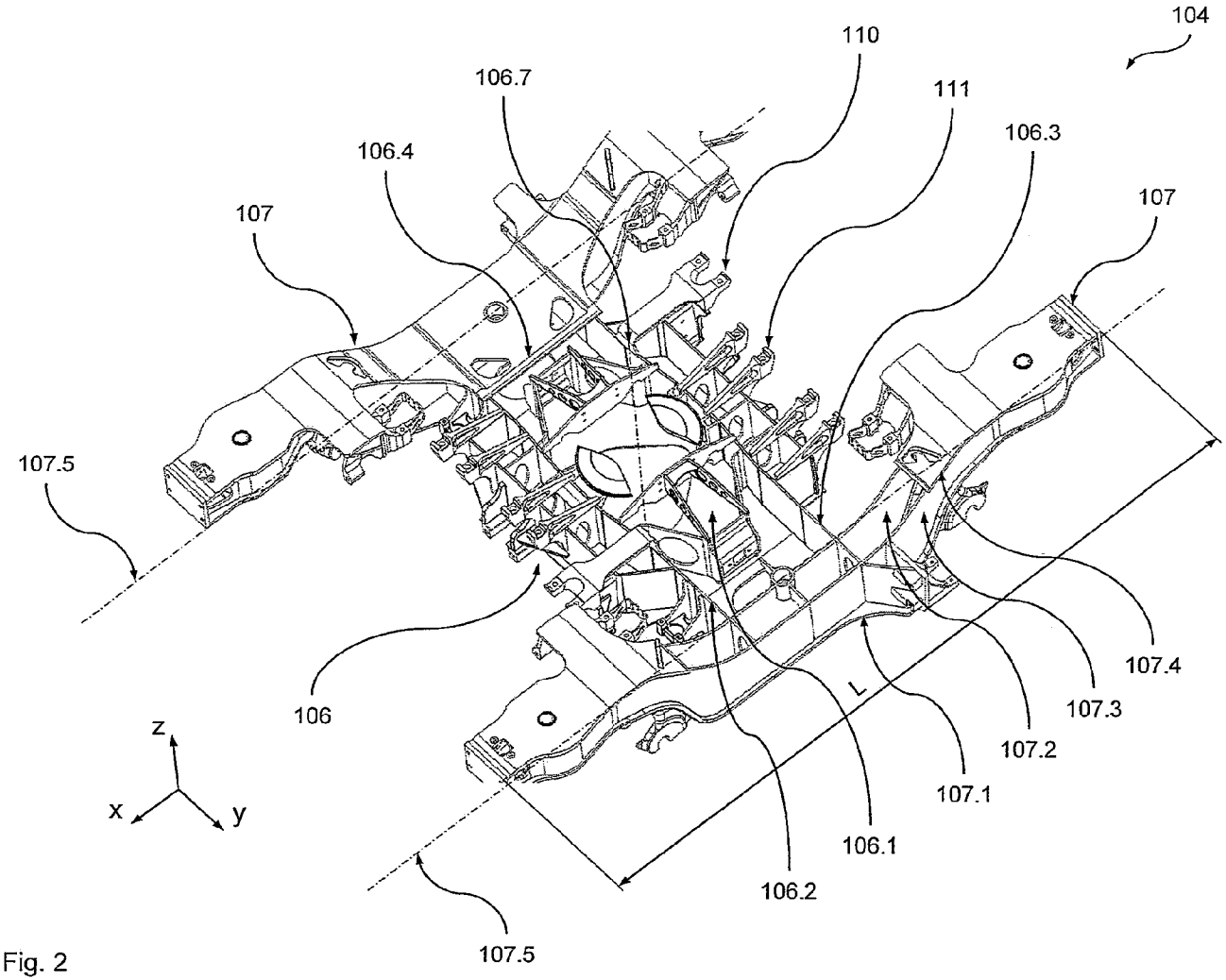
FIG. 2 is a schematic perspective top view, partly cut away, of part of the running gear frame from FIG. 1.

As may be taken from FIGS. 1 and 2, the front transverse web 106.2 and rear transverse web 106.3 are spaced apart in the frame longitudinal direction (x direction) by at least a web element distance QA, wherein the web element distance QA amounts to around 17% of the total length L of the longitudinal beam 107. In the present example, the minimum spacing of the transverse webs 106.2, 106.3 lies in the connecting zone at the inner longitudinal webs 107.2. It is evident, however, that in other variants of the invention this minimum spacing can also be present at other points in the transverse beam.

As is evident in particular from FIG. 1, the transverse beam lower chord 106.1 has a front longitudinal protrusion 106.5 and a rear longitudinal protrusion 106.6 which in the present example are designed substantially symmetrical to each other in relation to the central height axis 106.7 of the transverse beam 106. It is evident however that, in other variants of the invention, a design deviating from such symmetry can be selected.

The front longitudinal protrusion 106.5 and rear longitudinal protrusion 106.6 extend in the frame longitudinal direction beyond the front transverse web 106.2 and the rear transverse web 106.3, respectively, by at least a minimum amount $VL_{min}$ which amounts to 27% of the web element distance QA. The maximum amount $VL_{max}$ by which the front longitudinal protrusion 106.5 and the rear longitudinal protrusion 106.6 extend beyond the front transverse web 106.2 and the rear transverse web 106.3, respectively, in the frame longitudinal direction in the present example is about 53% of the web element distance QA.

The pronounced extension of the transverse beam lower chord 106.1 achieved by these longitudinal protrusions 106.5 and 106.6 beyond the transverse webs 106.2 and 106.3, respectively, achieves the advantage that the incident air flow starting from the leading running gear components such as wheelset 103.1, drive motor 105.1 and gearbox 105.2, can re-attach earlier in the area of the leading front longitudinal protrusion 106.5 to reform a boundary layer flow at the transverse beam lower chord 106.1, while, in the area of the trailing rear longitudinal protrusion 106.6, the detachment of the low drag boundary layer flow with reformation of a shear layer is delayed. In other words, advantageously, as a result, the length of the low drag boundary layer flow at the running gear underside is increased.

As a result of the earlier re-attachment and later detachment of the air flow, in the area of the transverse beam 106, a shear layer increasing drag and sound emission is only reformed behind the transverse beam 106 (in the direction of travel) and cannot expand again until there, so that over the running gear area as a whole a reduction in widening of the shear layer is achieved. This leads to reduced sound emission and reduced drag of the running gear 103.

The front longitudinal protrusion 106.5 and the rear longitudinal protrusion 106.6, in the frame transverse direction, each extend over a longitudinal protrusion region of the transverse beam 106 extending over the protrusion width VB which corresponds, in the present case, to about 57% of the longitudinal beam distance LA of the central longitudinal axes 107.5 of the longitudinal beams 107 in the frame transverse direction. Each of the protrusion regions is located between two longitudinal recessed parts of the transverse beam lower chord, wherein the recessed parts are defined as the concave parts having the configurations as shown in FIG. 1.

In the present example, the two longitudinal protrusions 106.5 and 106.6, in the frame transverse direction, are arranged substantially centrally. This takes account of the fact that directly on the inside, adjacent to the longitudinal beams 107 the wheel discs and brake units of wheelsets 103.1 are arranged which, firstly, reach comparatively close to the transverse webs 106.2 and 106.3 of the transverse beam 106 and, secondly, generate a correspondingly different flow situation.

To achieve the flow re-attachment at the transverse beam lower chord 106.1 and a boundary layer flow which is as interference-free and low drag as possible, the transverse beam lower chord 106.1, in the area of the two longitudinal protrusions 106.5 and 106.6 and in the area of the transverse webs 106.2 and 106.3, has a closed surface over its entire width between the longitudinal beams 107.

Particularly favorable flow conditions are furthermore achieved in that the transverse beam lower chord 106.1 has a substantially flat underside, whereby undesired interference with the re-attaching flow can be avoided.

In the central area (in relation to frame longitudinal direction) of the transverse beam lower chord 106.1 are provided a central opening 108 and two side openings 109 which allow easy access to the running gear components arranged inside the transverse beam 106. These openings 108, 109 in this central area have a less critical effect on the achieved reduction in drag and sound emission. This is because the closed leading sections of the transverse beam lower chord 106.1 as described above cause the flow to re-attach in front of and behind such an opening 108, 109 so that a brief flow detachment in the area of such an opening 108, 109 is less important.

In the present example the dimension of the passage opening 108 and 109, respectively, in the frame longitudinal direction is around 88% and 44%, respectively, of the web element distance QA while the dimension of the passage opening 108 an 109, respectively, in the frame transverse direction is about 25% and 10%, respectively, of the longitudinal beam distance LA. This minimizes as far as possible the interference to the air flow caused by the openings 108, 109.

As evident, in particular, from FIG. 1, the transverse beam lower chord 106.1 merges substantially steplessly with the respective longitudinal beam lower chord 107.1 in order to achieve a particularly favorable low drag flow at this point too.

A further particular advantage of the design shown is that the front longitudinal protrusion 106.5 and rear longitudinal protrusion 106.6 each form a lower paneling of consoles 110 and 111 protruding from the front transverse web 106.2 and the rear transverse web 106.3 in the frame longitudinal direction. The console 110 serves to support the gearbox 105.2 while the consoles 111 serve to attach the motor 105. This avoids or at least reduces an unfavorable influence on the air flow by the consoles 110 or 111.

The console 110 protrudes further from the cross web 106.2 and 106.3, respectively, in the frame longitudinal direction so as to achieve in this area the maximum amount $VL_{max}$ by which the front longitudinal protrusion 106.5 and the rear longitudinal protrusion 106.6, respectively, in the frame longitudinal direction, extends beyond the front transverse web 106.2 and the rear transverse web 106.3, respectively.

The present invention has been described above exclusively in relation to an example of a motorized bogie. It is evident, however, that it can be used in connection with unmotorized bogies or similar. Here, the benefits will be particularly useful as in this case there are no large leading or trailing components such as engine and gearbox at which the flow can attach, so that the transverse beam is responsible for an even greater proportion of the achievable reduction in drag and sound emission.

The present invention has been described above exclusively in relation to a vehicle for multiple unit rail vehicles for high speed traffic. It is evident, however, that the invention can also be used in connection with other rail vehicles.

What is claimed is:

1. A running gear frame for a rail vehicle comprising:

a central transverse beam, and two longitudinal beams rigidly connected together in a frame transverse direction via said central transverse beam, wherein said central transverse beam has at least a front web element, a rear web element and a transverse beam lower chord, said web elements run between said longitudinal beams in said frame transverse direction and in a frame height direction, and are connected with said longitudinal beams, and are arranged spaced apart in a frame longitudinal direction at least by a web element distance, said transverse beam lower chord is substantially plate shaped and extends on an underside of said central transverse beam from one of said longitudinal beams to the other one of said longitudinal beams and is connected with said web elements, said transverse beam lower chord, in at least one longitudinal protrusion extending in said frame transverse direction over a longitudinal protrusion region of said central transverse beam, extends beyond said front web element and/or said rear web element in said frame longitudinal direction by at least 10% of said web element distance, and wherein central longitudinal axes of said longitudinal beams, in said frame transverse direction, are spaced apart by a longitudinal beam distance and said longitudinal protrusion region, in said frame transverse direction, is located between two longitudinally recessed parts of said transverse beam lower chord, such that longitudinal protrusion region extends over 30% to 70% of said longitudinal beam distance.

2. The running gear frame according to claim 1, wherein said transverse beam lower chord, in at least one longitudinal protrusion extending in said frame transverse direction over a longitudinal protrusion region of said central transverse beam, extends beyond said front web element and/or said rear web element in said frame longitudinal direction by 20% to 40% of said web element distance.

3. The running gear frame according to claim 1, wherein said web element distance amounts to at least 10% of a total length of said longitudinal beams in said frame longitudinal direction.

4. The running gear frame according to claim 1, wherein said web element distance amounts to 15% to 25% of a total length of said longitudinal beams in said frame longitudinal direction.

5. The running gear frame according to claim 1, wherein said front web element at least in sections in said frame longitudinal direction forms a front outer limit of said transverse beam.

6. The running gear frame according to claim 1, wherein said rear web element at least in sections in said frame longitudinal direction forms a rear outer limit of said central transverse beam.

7. The running gear frame according to claim 1, wherein said longitudinal protrusion region extends over at least 40% of said longitudinal beam distance and up to 70% of said longitudinal beam distance.

8. The running gear frame according to claim 1, wherein said longitudinal protrusion region is arranged substantially centrally in said frame transverse direction.

9. The running gear frame according to claim 1, wherein, at least in an area of said longitudinal protrusion, said transverse beam lower chord has a substantially closed surface.

10. The running gear frame according to claim 1, wherein said transverse beam lower chord at least one of has a substantially flat underside at least in an area of said longitudinal protrusion, and has a substantially flat underside at least in said longitudinal protrusion region.

11. The running gear frame according to claim 1, wherein said transverse beam lower chord, at least in a region of said front web element, has a substantially closed surface over its entire extent in said frame transverse direction.

12. The running gear frame according to claim 1, wherein said transverse beam lower chord, at least in an area of said rear web element, has a substantially closed surface over its entire extent in said frame transverse direction.

13. The running gear frame according to claim 1, wherein said transverse beam lower chord, in a longitudinal central region lying in said frame longitudinal direction between said web elements, has a passage opening, wherein a dimension of said passage opening in said frame longitudinal direction amounts to at least one of less than 90% of said web element distance, less than 80% of said web element distance, and 60% to 80% of said web element distance.

14. The running gear frame according to claim 12, wherein central longitudinal axes of said longitudinal beams, in said frame transverse direction, are spaced apart by a longitudinal beam distance and a dimension of a passage opening in said frame transverse direction amounts to at least one of less than 30% of said longitudinal beam distance, less than 20% of said longitudinal beam distance, and 15% to 20% of said longitudinal beam distance.

15. The running gear frame according to claim 1, wherein said transverse beam lower chord merges substantially steplessly with a longitudinal beam lower chord of at least one of said longitudinal beams.

16. The running gear frame according to claim 1, wherein said transverse beam lower chord, at least over said longitudinal protrusion region, is formed of one piece.

17. The running gear frame according to claim 1, wherein said transverse beam lower chord in said longitudinal protrusion region forms a lower paneling of at least one console protruding in said frame longitudinal direction from one of said web elements.

18. The running gear frame according to claim 1, wherein at least said central transverse beam is formed as a welded construction.

19. A running gear with a running gear frame, wherein said running gear frame comprises a central transverse beam, and two longitudinal beams rigidly connected together in a frame transverse direction via said central transverse beam, said central transverse beam has at least a front web element, a rear web element and a transverse beam lower chord, said web elements run between said longitudinal beams in said frame transverse direction and in a frame height direction, and are connected with said longitudinal beams, and are arranged spaced apart in a frame longitudinal direction at least by a web element distance, said transverse beam lower chord is substantially plate shaped and extends on an underside of said central transverse beam from one of said longitudinal beams to the other of said longitudinal beams and is connected with said web elements, said transverse beam lower chord, in at least one longitudinal protrusion extending in said frame transverse direction over a longitudinal protrusion region of said central transverse beam, extends beyond said front web element and/or said rear web element in said frame longitudinal direction by at least 10% of said web element distance, and wherein central longitudinal axes of said longitudinal beams, in said frame transverse direction, are spaced apart by a longitudinal beam distance and said longitudinal protrusion region, in said frame transverse direction, is located between two longitudinally recessed parts of said transverse beam lower chord, such that longitudinal protrusion region extends over 30% to 70% of said longitudinal beam distance.

20. A rail vehicle with a running gear comprising a running gear frame, wherein said running gear frame comprises a central transverse beam, and two longitudinal beams rigidly connected together in a frame transverse direction via said central transverse beam, said central transverse beam has at least a front web element, a rear web element and a transverse beam lower chord, said web elements run between said longitudinal beams in said frame transverse direction and in a frame height direction, and are connected with said longitudinal beams, and are arranged spaced apart in a frame longitudinal direction at least by a web element distance, said transverse beam lower chord is substantially plate shaped and extends on an underside of said central transverse beam from one of said longitudinal beams to the other of said longitudinal beams and is connected with said web elements, said transverse beam lower chord, in at least one longitudinal protrusion extending in said frame transverse direction over a longitudinal protrusion region of said central transverse beam, extends beyond said front web element and/or said rear web element in said frame longitudinal direction by at least 10% of said web element distance, and wherein central longitudinal axes of said longitudinal beams, in said frame transverse direction, are spaced apart by a longitudinal beam distance and said longitudinal protrusion region, in said frame transverse direction, is located between two longitudinally recessed parts of said transverse beam lower chord, such that longitudinal protrusion region extends over 30% to 70% of said longitudinal beam distance.

21. The rail vehicle according to claim 20, wherein it is designed for high speed traffic with a nominal operating speed above 250 km/h, in particular above 300 km/h.

* * * * *

UNITED STATES PATENT AND TRADEMARK OFFICE

CERTIFICATE OF CORRECTION

PATENT NO. : 8,813,654 B2
APPLICATION NO. : 13/220875
DATED : August 26, 2014
INVENTOR(S) : Detlef Müller et al.

It is certified that error appears in the above-identified patent and that said Letters Patent is hereby corrected as shown below:

Title page, Item (75) Inventors, Line 1, delete "Seigen" and insert -- Siegen --

Title page, Item (75) Inventors, Line 3, delete "Krueztal" and insert -- Kreuztal --

Signed and Sealed this
Sixth Day of January, 2015

Michelle K. Lee

Michelle K. Lee
*Deputy Director of the United States Patent and Trademark Office*